US005305938A

United States Patent [19]

Nordlof

[11] Patent Number: 5,305,938

[45] Date of Patent: Apr. 26, 1994

[54] STRIP STOCK FEED APPARATUS WITH BALANCE FORCE FEED ROLL

[76] Inventor: Richard D. Nordlof, 3312 Crest Rd., Rockford, Ill. 61107

[21] Appl. No.: 926,635

[22] Filed: Aug. 10, 1992

[51] Int. Cl.[5] ..... B65H 26/02

[52] U.S. Cl. ..... 226/181; 226/174; 226/194

[58] Field of Search ..... 226/181, 186, 187, 174, 226/194, 176, 177; 100/164, 165, 166

[56] References Cited

U.S. PATENT DOCUMENTS

| | | | |
|---|---|---|---|
| 255,228 | 3/1882 | Wilde | 100/165 |
| 3,069,058 | 12/1962 | Haff, Jr. | 226/177 X |
| 3,299,801 | 1/1967 | Bishop | 226/194 X |
| 3,328,851 | 7/1967 | Whitehurst | 226/194 X |
| 3,441,188 | 4/1969 | May et al. | 226/194 X |
| 3,572,570 | 3/1971 | Mortenson | 226/177 |
| 3,943,031 | 3/1976 | Krueger et al. | 100/164 X |
| 4,053,092 | 10/1977 | Edwards | 226/181 X |
| 4,100,945 | 7/1978 | Reach et al. | 226/187 X |
| 4,420,107 | 12/1983 | Seyffert et al. | 226/32 |
| 4,505,015 | 3/1985 | Ross et al. | 29/116 R |
| 4,573,619 | 3/1986 | Grant | 242/76 X |
| 4,759,485 | 7/1988 | Brown et al. | 226/186 X |
| 4,763,852 | 8/1988 | Smith | 242/76 X |
| 4,770,550 | 9/1988 | Tahahashi | 226/194 X |
| 4,842,180 | 6/1989 | Kato | 226/176 |
| 5,217,152 | 6/1993 | Suzuki et al. | 226/187 X |

*Primary Examiner*—Daniel P. Stodola
*Assistant Examiner*—Paul Bowen
*Attorney, Agent, or Firm*—Vernon J. Pillote

[57] ABSTRACT

A roll type stock feed apparatus having first and second support shafts mounted on a frame with the axes of the first and second shafts in parallel relation and disposed in a plane transverse to the feed path, a first roll mounted on the first support shaft with the roll is axis coaxial with the first shaft axis, and a second roll is mounted on the second support shaft for limited longitudinal tilting movement relative to the second shaft axis. Roll drive mechanism is provided for driving the first and second rolls to advance stock along the feed path and includes a first toothed coupling member mounted on the second roll and having annularly arranged teeth coaxial with the second roll axis and a second toothed coupling member having annularly arranged teeth coaxial with the second shaft axis, the teeth on the first and second coupling members having working clearance therebetween sufficient to accommodate limited tilting movement of the second roll relative to the second roll axis. Guides are provided to substantially prevent tilting movement of the second roll in a direction crosswise of a plane containing the first and second shaft axes.

12 Claims, 3 Drawing Sheets

STRIP STOCK FEED APPARATUS WITH BALANCE FORCE FEED ROLL

BACKGROUND OF THE INVENTION

U.S. Pat. No. 4,505,015 discloses a roll type stock feed apparatus for advancing strip stock such as the metal strip used to form lead frames for integrated circuit chips, in which the lower roll is mounted for tilting movement at a location intermediate the ends of the lower roll so that the lower roll can rock back and forth as needed to automatically balance the forces applied across the width of the strip. In this prior stock feed apparatus, the tiltable force-balancing roller was not powered and accordingly all tractive force for feeding the strip stock, including accelerating and decelerating the strip stock during intermittent feed, had to be provided by the upper roll.

It is also known, for example as disclosed in U.S. Pat. No. 4,420,107 to provide a roll type stock feed apparatus for intermittently advancing strip stock such as lead frames, in which both rolls are driven in timed relation with each other. However, neither of the rolls in this patent are mounted for tilting movement to automatically balance the forces applied across the width of the strip.

SUMMARY OF THE INVENTION

It is an object of the present invention to provide a roll type stock feed apparatus in which one of the rolls is mounted for tilting movement in a direction crosswise of the strip to substantially balance the forces applied across the width of the strip, and having an improved arrangement for driving both feed rolls while accommodating tilting movement of the one feed roll in a plane crosswise of the stock feed path.

Accordingly, the present invention provides a roll type stock feed apparatus having first and second support shafts mounted on a frame with the axes of the first and second shafts in parallel relation and disposed in a plane transverse to the feed path. A first roll is mounted on the first support shaft with the roll axis coaxial with the first shaft axis, and a second roll is mounted on the second support shaft for limited longitudinal tilting movement relative to the second shaft axis. Roll drive means is provided for driving the first and second rolls to advance stock along the feed path, the roll drive means including a first toothed coupling member mounted on the second roll and having annularly arranged teeth coaxial with the second roll axis and a second toothed coupling member having annularly arranged teeth coaxial with the second shaft axis, the teeth on the first and second coupling members having working clearance therebetween sufficient to accommodate limited tilting movement of the second roll relative to the second roll axis.

The first and second coupling members are preferably located internally of the second feed roll with internal teeth on the first coupling member meshing with external teeth of the second coupling member.

DETAILED DESCRIPTION

Figure 1:
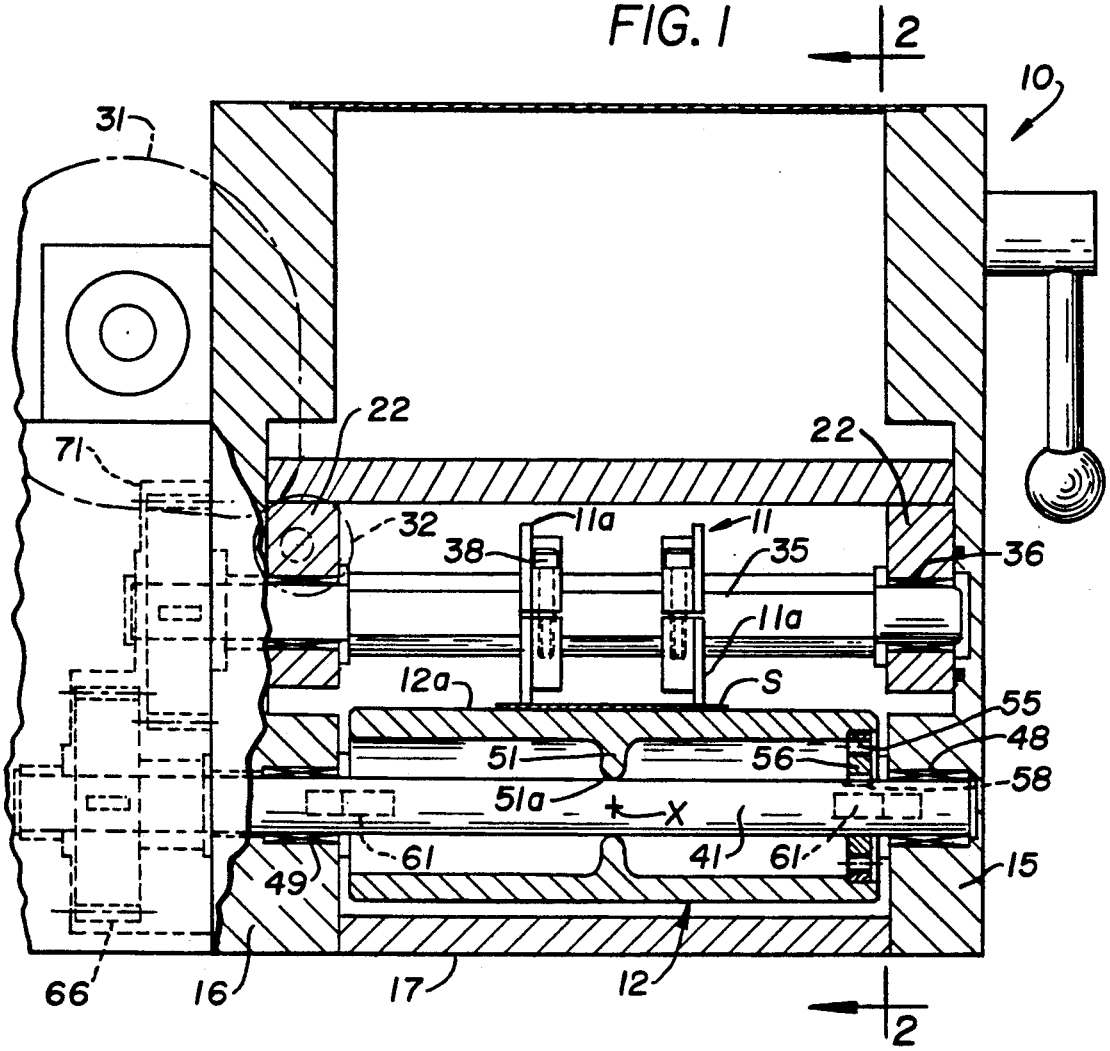
FIG. 1 is a transverse sectional view through the stock feed apparatus taken on the plane 1—1 of FIG. 2.
Figure 2:
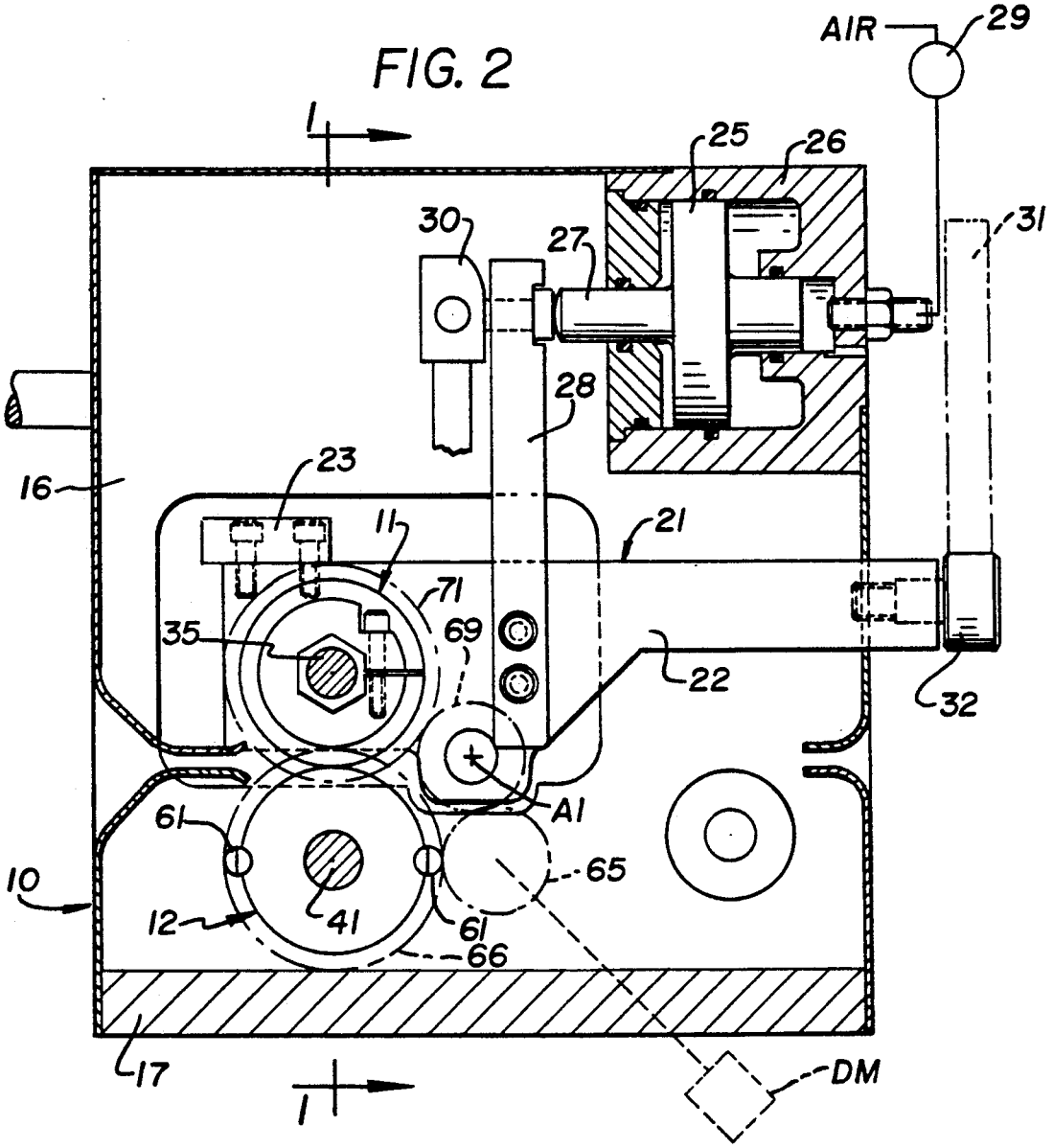
FIG. 2 is longitudinal sectional view through the stock feed apparatus taken on the plane 2—2 of FIG. 1 having a preferred embodiment of powered feed roll.

The roll type stock feed apparatus in general includes a frame 10 and upper and lower feed rolls 11 and 12, and a roll drive means for driving the upper and lower feed rolls to advance strip stock S therebetween. As best shown in FIGS. 1 and 2, the frame includes spaced frame side members 15 and 16 which may be in the form of castings, weldments or the like, and a bottom member 17 that extends between the side members and rigidly interconnects the same. One of the rolls, herein the upper roll 11, is mounted on a movable sub-frame 21 for shifting movement toward and away from the lower feed roll and into and out of engagement with the strip stock S therebetween. As is conventional, the sub-frame 21 includes spaced side members 22 and a cross member 23 and the sub-frame is mounted for pivotal movement about an axis Al parallel to the upper feed roll 11. Means are provided for yieldably pressing the upper feed roll downwardly into feeding engagement with a strip of stock between the upper and lower feed rolls. As best shown in FIG. 2, the pressure applying means includes a fluid actuated piston 25 slidable in a cylinder 26 fixed to the main frame and having a rod 27 extending out of the cylinder and engaging an arm 28 fixed to the movable frame. Fluid pressure such as air pressure is supplied to the side of the piston 25 opposite the rod 27 and the pressure is preferably made adjustable as by a pressure regulator 29 to adjust the pressure applied by the upper feed roll.

Some punch and die sets, for example progressive type punch and dies, punch a hole or holes in the stock at one station and have a pilot pin or pins adapted to enter the pilot hole at a subsequent die station, for final positioning of the stock during each press cycle. Various roll type stock feed apparatus have heretofore been made which are operative during each punch cycle to drive the feed rolls to advance the stock in a selected increment; to release the feed rolls from the stock prior to entrance of the pilot pins into the pilot holes, and to reapply the feed rolls prior to initiating a subsequent drive cycle of the feed rolls. In the embodiment illustrated, a mechanical actuator in the form of a cam 31 is provided for cyclically releasing feed pressure on the upper feed roll in timed relation with the operation of the press. As is conventional, the cam is driven in timed relation with the operation of the press and engages a follower 32 on one of the side members 22 of the sub-frame 21, to pivot the movable sub-frame about the axis Al in timed relation with the operation of the press, and while the air pressure acting on piston 25 remains substantially constant. A manually operable cam 30 is provided for moving the upper feed roll to a stock release position to facilitate manual insertion of an end of the stock between the rolls during start-up.

The upper roll means 11 is mounted on a first shaft 35 with the outer work engaging surfaces 11*a* of the upper roll means coaxial with the lengthwise axis of the first shaft. As shown, the shaft 35 is rotatably supported by bearings 36 on the movable frame 21. In feeding some feed stock, for example strips of lead frames, it is desirable to contact the upper surface of the stock only along two or three localized areas of the strip, for example adjacent opposite side edges of the strip in some types of feed frames, and adjacent opposite side edges and also along the center of the strip, in the so-called double lead frame strips. As shown in FIG. 2, the upper feed roll means is in the form of narrow disks which are mounted for adjustment along the shaft 35 so as to contact the strip at the desired location, and which can be locked in adjusted position by screws 38. Shaft 35 preferably has a non-circular cross-section such as a polygonal cross-section to provide a good driving connection between the shaft and disks.

A second shaft 41 is mounted on the frame 10 with its lengthwise axis extending parallel to the lengthwise axis of the first shaft 35. The lower roll means has a lower roll axis and an outer work engaging surface 12*a* coaxial with a lower roll axis. A passage extends through the lower roll means and means are provided for mounting the lower roll means on the second support shaft for longitudinal tilting movement of the axis of the lower roll relative to the second shaft axis, at a location medially between the ends of the work engaging surface of the lower roll means. Means are provided for driving the first and second roll means 11 and 12 at the same peripherial speed and in relatively opposite directions so as to advance the strip stock S. In the embodiment of FIGS. 1 and 2, the second shaft 41 is rotatably supported by bearings 48 and 49 in the side frame members 15 and 16 respectively. The lower roll means 12 has an inwardly extending rib 51 that terminates in a rounded annular apex 51*a* which closely receives the shaft 41 and pivotally supports the lower roll means thereon for movement about a pivot axis X (FIG. 1). The drive means includes a first internally toothed coupling member 55 mounted on the lower roll means and having teeth arranged in an annular array coaxial with the second roll axis, and a second externally toothed coupling member 56 having teeth arranged in an annular array coaxial with the axis of the second shaft 41. The teeth on the first and second coupling members interengage and have a working clearance therebetween sufficient to accommodate limited tilting movement of the second roll axis relative to the second shaft axis. In the embodiment shown in FIGS. 1 and 2, the coupling members 55 and 56 are located internally of the second roll means adjacent one end of the latter. It is contemplated, however, that the coupling members could be located internally of the second roll means and relatively closer to the pivot axis X to reduce the amount of working clearance between the interengaging teeth required to accommodate a preselected amount of tilting movement of the lower roll axis relative to the axis of the second shaft 41. The inner coupling member 56 is drivingly connected to the shaft 41 for rotation therewith as by a spline 58. Means are also provided for substantially preventing tilting movement of the lower roll 12 in a direction crosswise of a plane through the axes of first and second shafts 36 and 38. In the embodiment illustrated, this means includes pins 61 mounted in bores in one or both of the side frame members at locations to engage the periphery of the lower roll 12 and prevent tilting movement in a horizontal plane while accommodating tilting movement in a vertical plane through the axes of the first and second shafts. The lower roll only needs to tilt one or two degrees in order to accommodate the usually small differences in thickness between the lengthwise edges of strip S. The internally and externally toothed coupling members 55 and 56 may for example, comprise conventional shaft couplings having an internally splined outer member and an externally splined inner member with a working clearance that can accommodate a few degrees of misallignment, or external and internal gear members selected to have a form clearance therebetween sufficient to accommodate limited radial movement therebetween.

The shafts 35 and 48 are drivingly interconnected by gearing to a drive motor diagrammatically indicated at DM in FIG. 2. As shown in FIGS. 1 and 2, a drive gear 65 is drivingly connected to the motor DM and meshes with a gear 66 non-rotatably connected to shaft 41. Drive gear 65 also meshes with an idler gear 69 that is rotatable about the pivot axis Al of the movable subframe, and idler gear 69 drives a gear 71 keyed to the first shaft 35. Thus, the upper and lower shafts are driven at the same speed but in relatively opposite directions so as to drive the upper and lower feed rolls to advance feed stock therebetween. The movable frame can be pivoted about the pivot axis Al to raise and lower the upper feed roll into and out of engagement with the strip stock while the gears 65, 66, 69 and 71 remain in meshing engagement. The first and second coupling members drive the lower roll with the shaft 38, while accommodating tilting movement of the axis of the lower roll relative to the axis of the shaft 41.

Figure 3:
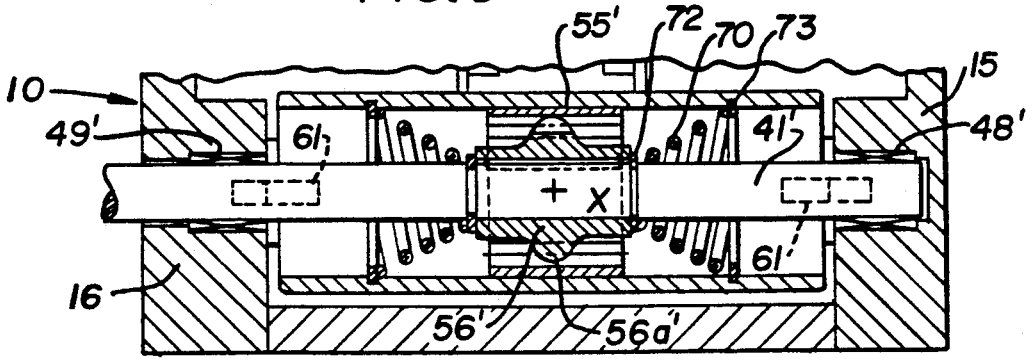
FIG. 3 is a fragmentary transverse sectional view illustrating a second embodiment of powered tiltable feed roll.
Figure 5:
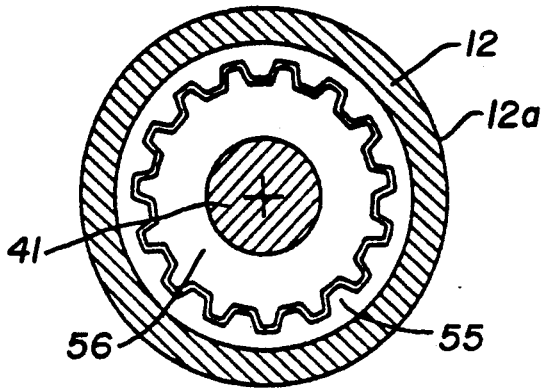
FIG. 5 illustrates an end view of the internally and externally toothed members.
Figure 6:
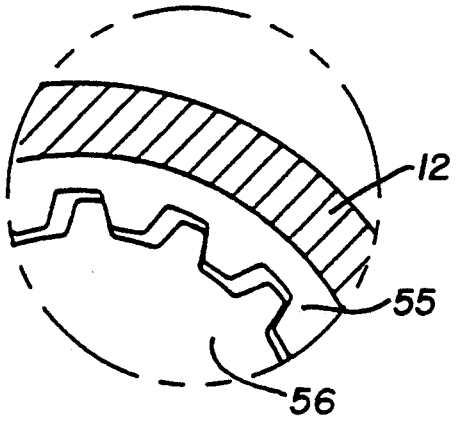
FIG. 6 is a fragmentary view illustrating the internally and externally toothed members in a driving condition.

A feed apparatus having modified driven tiltable roll is illustrated in FIG. 3 and like numerals are used to designate the same parts and like numerals followed by the postscript ′ are used to designate modified parts. In this embodiment, the shaft 41′ is rotatably supported by bearings 48′ and 49′ on the frame members 15 and 16. An internally toothed coupling member 55′ is disposed internally of the lower roll and non-rotatably connected thereto at a location medially between the ends of the lower roll. The internally toothed coupling member 55′ defines an inwardly facing support surface at the roots of the teeth and an externally toothed coupling member 56′ is non-rotatably connected to the shaft 41′ and has external teeth arranged in annular array and which mesh with the internal teeth on the coupling member 55′. The coupling member 56′ is formed with a longitudinally convex outer support surface 56*a*′ engageable with the inwardly facing support surface on the coupling member 55′ to support the lower roll for limited tilting movement relative to the axis of the shaft 41 about a pivot axis X intermediate the ends of the lower roll. As in the preceding embodiment, a means such as pins 61 are provided on the stationary frame and arranged to engage the outer periphery of the roll 12′ to prevent tilting movement of the roll relative to the shaft in a horizontal plane while accommodating limited tilting movement of the roll in a vertical plane through the axes of shafts 35′ and 41′. Means are also provided for limiting endwise movement of the lower roll 12 relative to the shaft and, as shown, conical springs 70 are interposed between collars 72 on the shaft 41 and collars 73 on the lower roller. Shaft 41′ is driven in the same manner as described above in connection with shaft 41.

Figure 4:
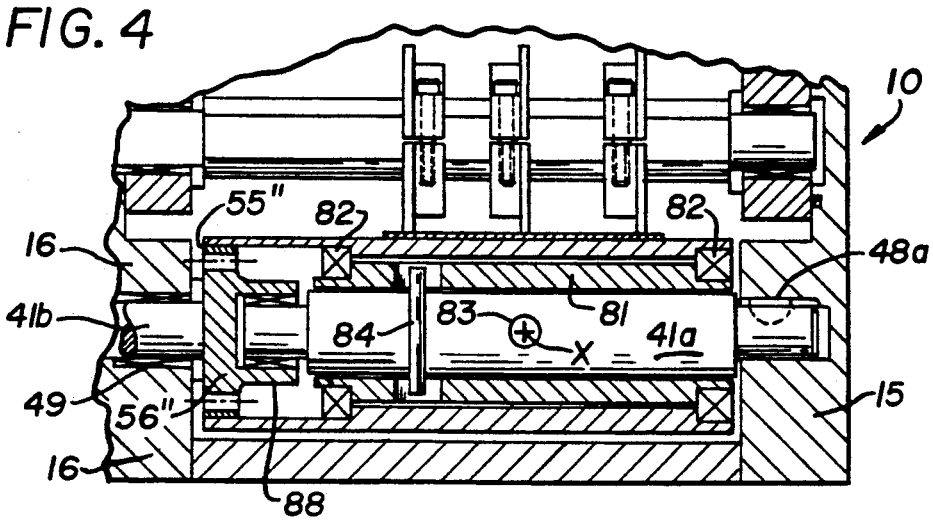
FIG. 4 is a fragmentary transverse sectional view illustrating a third embodiment of powered tiltable feed roll.

A stock feed apparatus having a further modified form of driven tiltable roll is illustrated in FIG. 4. In this embodiment, the lower support shaft means has a stationary portion 41*a* non-rotatably connected as by a key 48*a* to the frame member 15 and a rotary portion 41*b* that is rotatably supported by a bearing 49 in frame member 16. A tubular member 81 is disposed internally of the lower roll 12 and the lower roll is rotatably supported on the tubular member by bearings 82 for rotation relative thereto about the roll axis. The stationary portion 41*a* of the lower shaft means extends through the tubular member and a pivot pin 83 supports the tubular member on the stationary portion 41*a* of the lower shaft means for tilting movement relative thereto about axis X perpendicular to the axis of the lower shaft means. The pin 83 is disposed horizontally at a location medially between the ends of the work engaging surface of the lower roll and extends in a plane perpendicular to a plane through the axes of the upper and lower shafts. A pin 84 is also mounted on the stationary portion of the lower shaft means and extends into longitudinally elongated slots 85 in the tubular member, to confine pivotal movement of the tubular member and hence the lower roll, to movement in a vertical plane.

The lower roll is drivingly connected to the shaft by an internally toothed coupling member 55' fixed to the lower roll and having teeth arranged in an annular array coaxial with the axis of the lower roll, and a an externally toothed coupling member 56'' fixed to the rotary portion 41*b* of the lower shaft and having teeth arranged in an annular array coaxial with the axis of the shaft portion 41*b* of the lower shaft means. The teeth on the first and second coupling members interengage and have a working clearance therebetween sufficient to accommodate limited tilting of the axis of the lower roll relative to the axis of the lower shaft means. The rotary portion 41*b* of the lower shaft means is advantageously provided with a hub 88 that rotatably receives and supports an end of the stationary portion 41*a*, to maintain the shaft portions 41*a* and 41*b* in axial alignment.

From the foregoing it is believed that the construction and operation of the stock feed apparatus will be readily understood. Both the upper and lower feed rolls are driven to advance the strip stock therebetween. The lower feed roll is supported for tilting movement about an axis intermediate the ends of the lower roll and tilting movement of the lower roll in a horizontal plane is effectively prevented so as to confine the tilting movement to a vertical plane containing the axes of upper and lower support shafts. The lower roll is driven through first and second coupling members having interengaging teeth with a working clearance therebetween sufficient to accommodate limited tilting of the axis of the lower roll relative to the axis of the second shaft. With this arrangement, both the upper and lower rolls can be driven to advance the feed stock while the lower roll can tilt to balance or equalize the forces applied across the width of the strip stock. Means (not shown) are provided for laterally guiding the strip stock to maintain the stocks generally centered with respect to the pivot axis X of the lower feed roll and, when the upper roll means is in the form of two or more disks as shown, these disks are adjusted along the upper shaft so as to engage the strip stock at locations generally symmetrical with respect to the pivot axis X.

The embodiments of the invention in which an exclusive property or privilege is claimed are defined as follows:

1. A roll type strip stock feed apparatus for advancing strip stock along a feed path comprising, a frame assembly, first and second support shafts having respective first and second shaft axes, means mounting the first and second support shafts on the frame assembly with the first and second shaft axes in parallel relation and disposed in a plane transverse to the feed path, a first feed roll having a work engaging surface coaxial with a first roll axis, means non-rotatably mounting the first feed roll on the first support shaft with the first roll axis coaxial with the first shaft axis, a second feed roll having an outer work engaging surface coaxial with a second rill axis and a passage extending axially through the second feed roll, means mounting the second feed roll on the second support shaft for longitudinal tilting movement of the second roll axis relative to the second shaft axis at a location intermediate ends of the second feed roll, and drive means for driving said first and second feed rolls to advance stock along the feed path, said drive means including a first toothed coupling member mounted on the second feed roll and having teeth arranged in an annular array coaxial with said second roll axis, a second toothed coupling member having teeth arranged in an annular array coaxial with said second shaft axis, the teeth on the first and second coupling members interengaging and having working clearance therebetween sufficient to accommodate limited tilting of the second roll axis relative to the second shaft axis, and means for substantially preventing tilting movement of the second feed roll in a direction crosswise of said plane while accommodating tilting movement in said plane.

2. A roll type strip stock feed apparatus according to claim 1 wherein said first coupling member has internal teeth and said second coupling member has external teeth.

3. A roll type strip stock feed apparatus according to claim 1 wherein said first and second coupling members are located internally of said second feed roll.

4. A roll type strip stock feed apparatus according to claim 1 wherein said means for substantially preventing tilting movement of said second feed roll in a direction crosswise of said plane includes guides fixed to the frame assembly and engaging the second feed roll.

5. A roll type strip stock feed apparatus according to claim 1 wherein said means mounting the second feed roll on the second support shaft includes a tubular member internally of the second feed roll and means mounting the second feed roll on the tubular member for rotation relative thereto about the second roll axis, the second support shaft extending through the tubular member, and means mounting the tubular member on the second support shaft for tilting movement relative thereto about an axis perpendicular to said second shaft axis and orthogonal to said plane.

6. A roll type strip stock feed apparatus for advancing strip stock along a feed path comprising, a frame assembly, first and second roll support shafts mounted on the frame assembly for rotation about parallel first and second shaft axes disposed in a plane transverse to the feed path, a first feed roll having an outer work engaging surface coaxial with a first roll axis, means non-rotatably mounting the first feed roll on the first roll support shaft with the first roll axis coaxial with the first shaft axis, a second feed roll having a passage extending axially therethrough and an outer work engaging surface coaxial with a second roll axis, means mounting the second feed roll on the second roll support shaft for longitudinal tilting movement of the second roll axis relative to the second shaft axis at a location intermediate the ends of the second feed roll, a first coupling member mounted on the second feed roll for rotation therewith and having teeth arranged in an annular array coaxial with the second feed roll, a second coupling member mounted on the second roll support shaft for rotation therewith and having teeth arranged in an annular array concentric with the second support shaft, the teeth on the first and second coupling members interengaging and having working clearance therebetween sufficient to accommodate limited tilting of the second roll axis relative to the second shaft axis, means for driving the first and second roll support shafts to advance strip stock therebetween along the feed path, and means for substantially preventing tilting movement of the second feed roll in a direction crosswise of said plane while accommodating tilting movement in said plane.

7. A roll type strip stock feed apparatus according to claim 6 wherein said first coupling member has internal teeth and said second coupling member has external teeth.

8. A roll type stock feed apparatus according to claim 7 wherein said means mounting said second feed roll on the second roll support shaft includes an inwardly facing support surface on the first internally toothed coupling member and a longitudinally convex outwardly facing support surface on the second externally toothed coupling member engageable with the inwardly facing support surface.

9. A roll type strip stock feed apparatus according to claim 6 wherein said first and second coupling members are located internally of said second feed roll.

10. A roll type strip stock feed apparatus according to claim 6 wherein said means for substantially preventing tilting movement of said second feed roll in a direction crosswise of said plane includes guides fixed to said frame assembly and engaging the second feed roll.

11. A roll type strip stock feed apparatus according to claim 6 wherein said means mounting the second feed roll on the second roll support shaft includes inwardly extending rib means on the second feed roll providing an inwardly facing annular support surface intermediate the ends of the second feed roll, said second roll support shaft having an outer surface engaging said inwardly facing support surface.

12. A roll type strip stock feed apparatus according to claim 6 wherein said means mounting the second feed roll on the second roll support shaft includes outwardly extending rib means on the second roll support shaft providing an outwardly facing support surface, said second feed roll having inner surface means engaging the outwardly facing support surface.

* * * * *